US009777349B2

(12) United States Patent
Maderud et al.

(10) Patent No.: US 9,777,349 B2
(45) Date of Patent: Oct. 3, 2017

(54) METHOD OF MAKING A CEMENTED CARBIDE OR CERMET BODY

(71) Applicant: SANDVIK INTELLECTUAL PROPERTY AB, Sandviken (SE)

(72) Inventors: Carl-Johan Maderud, Stockholm (SE); Tommy Flygare, Stockholm (SE); Michael Carpenter, Warwickshire (GB); Jane Smith, Coventry (GB)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 690 days.

(21) Appl. No.: 14/352,314

(22) PCT Filed: Oct. 17, 2012

(86) PCT No.: PCT/EP2012/070557

§ 371 (c)(1),
(2) Date: Apr. 16, 2014

(87) PCT Pub. No.: WO2013/057136

PCT Pub. Date: Apr. 25, 2013

(65) Prior Publication Data

US 2014/0271321 A1 Sep. 18, 2014

(30) Foreign Application Priority Data

Oct. 17, 2011 (EP) ..... 11185483
Apr. 4, 2012 (EP) ..... 12163181

(51) Int. Cl.
*C22C 29/00* (2006.01)
*C22C 29/08* (2006.01)
(Continued)

(52) U.S. Cl.
CPC ..... *C22C 29/00* (2013.01); *B01F 3/18* (2013.01); *B01F 11/02* (2013.01); *B22F 1/0048* (2013.01);
(Continued)

(58) Field of Classification Search
CPC ..... C22C 1/051; C22C 29/00; C22C 29/08; B01F 11/02; B01F 3/18; B22F 1/0048; B22F 2202/01; B22F 9/026
(Continued)

(56) References Cited

U.S. PATENT DOCUMENTS 4,013,460 A * 3/1977 Brown ..... C22C 1/055 419/18
5,328,763 A 7/1994 Terry
(Continued)

FOREIGN PATENT DOCUMENTS

CN 101020971 A 8/2007
CN 101967593 2/2011
(Continued)

OTHER PUBLICATIONS

Written Opinion of the International Search Authority mailed Apr. 22, 2014 for PCT/EP2012/070557; 11 pages.*
(Continued)

*Primary Examiner* — Helene Klemanski
(74) *Attorney, Agent, or Firm* — Corinne R. Gorski

(57) ABSTRACT

The present invention relates to a method of making a cemented carbide or a cermet body comprising the steps of first forming a powder blend comprising powders forming hard constituents and metal binder. The powder blend is then subjected to a mixing operation using a non-contact mixer wherein acoustic waves achieving resonance conditions to form a mixed powder blend and then subjecting said mixed powder blend to a pressing and sintering operation. The
(Continued)

method makes it possible to maintain the grain size, the grain size distribution and the morphology of the WC grains.

15 Claims, 2 Drawing Sheets

(51) Int. Cl.

| | |
|---|---|
| ***C22C 1/05*** | (2006.01) |
| ***B22F 1/00*** | (2006.01) |
| ***B22F 9/02*** | (2006.01) |
| ***B01F 11/02*** | (2006.01) |
| ***B01F 3/18*** | (2006.01) |

(52) U.S. Cl.
CPC ..... *C22C 1/051* (2013.01); *C22C 29/08* (2013.01); *B01F 2215/0454* (2013.01); *B22F 9/026* (2013.01); *B22F 2202/01* (2013.01)

(58) Field of Classification Search
USPC ..... 419/10, 12, 13, 16, 17, 18
See application file for complete search history.

(56) References Cited

U.S. PATENT DOCUMENTS

| | | | | |
|---|---|---|---|---|
| 5,441,693 | A * | 8/1995 | Ederyd | B22F 1/0048 419/10 |
| 5,505,902 | A | 4/1996 | Fischer et al. | |
| 6,423,112 | B1 * | 7/2002 | .ANG.kerman | C22C 29/08 75/240 |
| 7,017,677 | B2 | 3/2006 | Keshavan et al. | |
| 7,188,991 | B1 | 3/2007 | Weiler | |
| 7,188,993 | B1 | 3/2007 | Howe et al. | |
| 7,682,557 | B2 * | 3/2010 | Yong | C22C 29/08 419/10 |
| 7,866,878 | B2 | 1/2011 | Howe et al. | |
| 9,399,600 | B2 * | 7/2016 | Smith | B22F 3/10 |
| 9,453,271 | B2 * | 9/2016 | Carpenter | C22C 29/08 |
| 2009/0003123 | A1 | 1/2009 | Morrison | |
| 2012/0111976 | A1 * | 5/2012 | Tillman | C22C 1/051 241/15 |
| 2015/0098855 | A1 * | 4/2015 | Carpenter | C22C 29/08 419/18 |

FOREIGN PATENT DOCUMENTS

| | | | |
|---|---|---|---|
| CN | 101920336 | A | 12/2011 |
| EP | 1231288 | A1 | 8/2002 |
| EP | 1552879 | A1 | 7/2005 |
| EP | 1900421 | | 3/2008 |
| EP | 2246113 | | 11/2010 |
| EP | 2584057 | A1 * | 4/2013 |
| GB | 2391236 | A | 2/2004 |
| JP | H445535 | U | 4/1992 |
| JP | 201314792 | A | 1/2013 |
| WO | 98/03690 | | 1/1998 |
| WO | 0206545 | A2 | 1/2002 |
| WO | 2008088321 | A1 | 7/2008 |

OTHER PUBLICATIONS

"Ultrasonic Mixing in Microfluidic Channels Using Integrated Transducers"; Yaralioglu et al.; Anal. Chem., Jul. 1, 2004, 76(13), pp. 3694-3698.*
"Microfluidic Mixing: A Review"; Lee et al.; International Journal of Molecular Sciences, May 18, 2011, 12(5), pp. 3263-3287.*
http://www.resodynmixers.com/technologies/; 2009,

* cited by examiner

METHOD OF MAKING A CEMENTED CARBIDE OR CERMET BODY

RELATED APPLICATION DATA

This application is a §371 National Stage Application of PCT International Application No. PCT/EP2012/070557 filed Oct. 17, 2012 claiming priority of EP Application Nos. 11185483.2, filed Oct. 17, 2011 and 12163181.6 filed Apr. 4, 2012.

The present relates to a method of making a cemented carbide or cermet body where the powder constituents are subjected to a non-milling mixing operation by using an acoustic mixer.

BACKGROUND

Cemented carbide and cermet powders used for making sintered bodies for e.g. cutting tools for metal machining, wear parts, in mining applications etc. are usually made by first forming a slurry by milling the powder constituents together with binder metal powders, organic binder (e.g. polyethylene glycol) and a milling liquid in either a ball mill or an attritor mill for several hours. The slurry is then usually subjected to a spray drying operation to form granulated cemented carbide or cermet powders which can be used to press green parts that are subsequently sintered.

The main purpose of the milling operation is to obtain a good binder phase distribution and good wettability between the hard constituent grains and the binder phase powder, and in some cases de-agglomerate WC crystals. A good binder phase distribution and good wettability is essential for achieving cemented carbide and cermet materials of high quality. If the phase distribution or wettability is poor, pores and cracks will be formed in the final sintered body which is detrimental for the material. However, obtaining a good binder phase distribution and wettability is very difficult for these types of materials and requires a high input of energy, i.e. quite long milling times, usually 10-40 hours depending on the type of mill used and/or the grade produced. To achieve coarser grain size grades the milling time is relatively low such to minimize WC crystal breakdown whilst trying to ensure good binder distribution.

Ball mills and attritor mills both provide good, homogenous mixing of the powder constituents, binder metal powders and the organic binder. These processes provides a large energy input that can overcome the static friction and binding forces that is required to obtain a good binder phase distribution and good wettability. However, such mills will subject the powders to a milling operation. Hence, the powders, both hard constituent powders and binder metal powders, will partly be grinded so that a fine fraction will be formed. This fine fraction can cause uncontrolled grain growth during the subsequent sintering. Hence, narrow sized raw material can be destroyed by milling.

It is difficult to produce well controlled narrow grain size microstructures since the milling produce a fine fraction that contribute to an uncontrolled grain growth during sintering.

Several attempts have been done to solve this problem. One method designed to obtain a powder comprising a coarse grained WC with a good binder phase distribution, is to deposit a salt, e.g. cobalt acetate, onto the WC-particles, then subjecting the coated WC grains to an elevated temperature thus reducing the cobalt acetate to cobalt. By doing this prior to milling, a good cobalt distribution can be obtained at a reduced grinding time. These types of processes are quite complicated and time consuming. One example of this type of process is described in EP752921B1. Such methods are quite complicated and costly and indeed still require a milling step.

Other types of non-milling mixing methods have also been tested with the aim to avoid the grinding of the powders and thus maintaining properties like grain size of the raw materials.

EP 1 900 421 A1 discloses a process where the slurry is homogenized in a mixer comprising a rotor, a dispersing device and means to circulate the slurry. The dispersion device contains moving parts.

Conventional manufactured WC powder used for cemented carbide is characterized as fairly agglomerated and with different grain shapes and ranges. The non-uniformity of WC powder results from the heterogeneity of the W powder produced by reduction and this can become even more mixed during the subsequent carburization stage. Furthermore, during sintering any WC agglomerates may form larger sintered carbide grains and contain an increased frequency of sigma2 boundaries, i.e. carbide grains together without cobalt layer.

Single crystal WC raw material having an angular or spherical morphology are usually manufactured by being carburized at high temperature and after the W metal has been deagglomerated.

Single crystal WC raw material having an angular or spherical morphology and narrow distribution, are commonly used in applications that requires a superior toughness: hardness relationship e.g. mining applications. In such applications, it is important that the narrow grain size distribution and the morphology are preserved as much as possible.

In order to minimize the milling time, the milling step has been combined with other methods to obtain a good mixing between WC and cobalt.

One object of the present invention is to obtain a homogenous powder blend without milling to form a cemented carbide or cermet body.

Another object of the present invention is to obtain a powder blend where the grain size distribution of the raw materials can be maintained while still obtaining a homogenous powder blend.

Another object of the present invention is to obtain a powder blend using a mixing process that does not contain any moving parts and is subjected to a minimum amount of wear.

It is further an object of the present invention to provide a method making it possible to maintain the grain size, distribution and the morphology of the in the sintered material while still achieving a good mixing.

DETAILED DESCRIPTION OF THE PRESENT INVENTION

Figure 1:
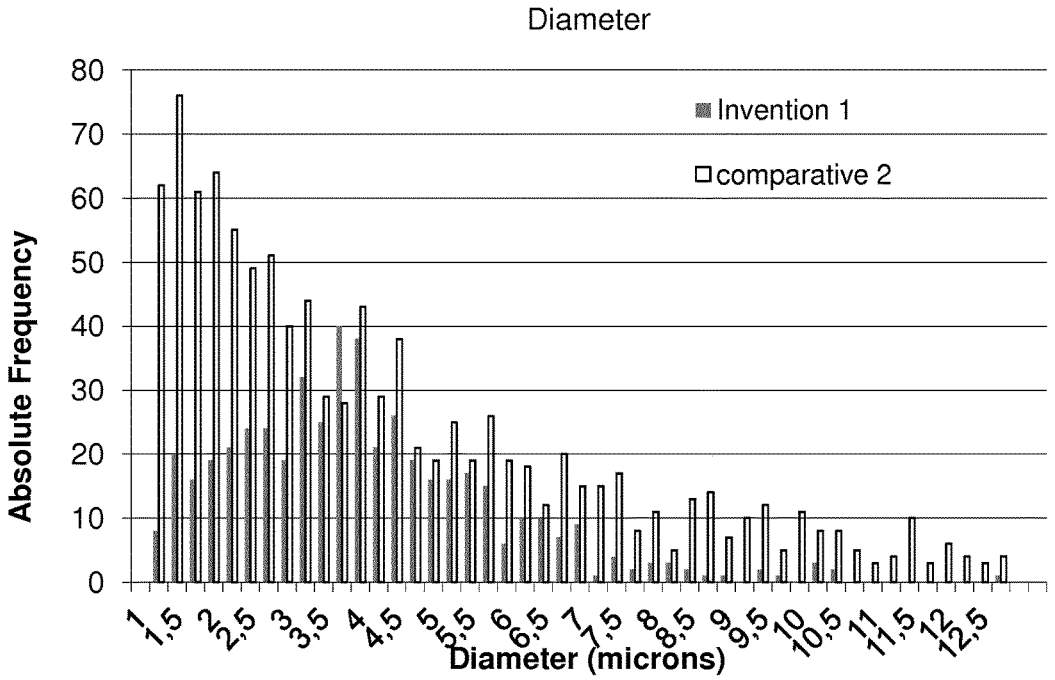
FIG. 1 shows the grain size distribution comparing Invention 4 and Comparison 4 from Examples 5 and 7.

The present invention relates to a method of making a cemented carbide or cermet body comprising the steps of first forming a powder blend comprising powders forming hard constituents and metal binder. The powder blend is then subjected to a mixing operation using a non-contact mixer wherein acoustic waves achieving resonance conditions is used to form a mixed powder blend. Those types of mixers are usually called resonant acoustic mixers. The mixed powder blend is then subjected to a forming and a sintering operation.

The mixing of the raw material powders are suitably performed using a non-contact mixer wherein acoustic waves achieving resonance conditions, preferably in a resonant acoustic mixer apparatus. Acoustic mixers are known in the art, see e.g. WO2008/088321 and U.S. Pat. No. 7,188,993. Such mixers use low-frequency, high intensity sound energy for mixing. They have shown good results when mixing fragile organic compounds but also other types of materials have been mixed. Acoustic mixers are non-contact mixers, i.e. they do not contain any mechanical means for mixing such as milling bodies, stirrers, baffles or impellars. Instead, the mixing is performed by creating micro-mixing zones throughout the entire mixing vessel by mechanical resonance applied to the materials to be mixed by the propagation of an acoustic pressure wave in the mixing vessel. A mechanical resonance, also called natural vibration or self-oscillation, is a general phenomenon of a vibrating system where the amplitude of the vibration becomes significantly amplified at a resonance frequency. At resonance frequency even a weak driving force applied to the system can provide a large amplitude, and hence a high mixing efficiency of the system.

One advantage with the method according to the present invention is the short treatment (mixing time) to achieve homogeneity of the mixture and that little or no mechanical damage, fracture or stresses are induced in the WC crystals. Furthermore in the utilizing of this process in the system gives the advantage that the energy consumption is low. Thus no change is made to the grain size or distribution of the hard constituent powders by the acoustic mixing process.

In one embodiment of the present invention the vibrations are acoustic vibrations. Acoustic waves are utilized to put the system in resonant condition. The acoustic frequencies are considered to be within the interval 20-20 000 Hz whereas ultrasound frequencies are usually above 20 000 Hz. In another embodiment of the present invention the vibrations has a frequency of 20-80 Hz, preferably 50-70 Hz.

In one embodiment of the present invention the vibrations have an acceleration (sometimes called energy) of 10-100 G, preferably 30-50 G, most preferably 40 G, where 1 G=9.81 $m/s^2$.

In the method according to the present invention the one or more powders forming the hard constituents is selected from borides, carbides, nitrides or carbonitrides of metals from groups 4, 5 and 6 of the periodic table, preferably of tungsten, titanium, tantalum, niobium, chromium and vanadium. The grain size of the powders forming hard constituents depends on the application for the alloy and is preferably from 0.2 to 30 μm. If not otherwise specified, all amounts in wt % given herein are the wt % of the total dry weight of the dry powder constituents.

The binder metal powders can either be in a powder of one single binder metal, or a powder blend of two or more metals, or a powder of an alloy of two or more metals. The binder metals are selected from Cr, Mo, Fe, Co or Ni, preferably from Co, Cr or Ni. The grain size of the added binder metal powders is suitably between 0.5 to 3 μm, preferably between 0.5 to 1.5 μm.

When the method according to the present invention relates to making a cemented carbide body, it is herein meant that cemented carbide is WC-Co based, which also can contain, in addition to WC and Co, additions such as grain growth inhibitors, cubic carbides etc. commonly used in the art of making cemented carbides.

In one embodiment of the present invention, a cemented carbide body is made of hard constituents suitably comprising WC with a grain size of between 0.5 to 2 μm, preferably between 0.5 to 0.9 μm. The binder metal content is suitably between 3 to 17 wt %, preferably 5 to 15 wt % of the total dry weight of the dry powder constituents. Cemented carbides made from these powders are commonly used in cutting tools such as inserts, drills end-mills etc.

In one embodiment of the present invention, a cemented carbide body is made of hard constituents suitably comprising WC having a grain size between 1 to 8 μm, preferably between 1.5 to 4 μm. The binder metal content is suitably between 3 to 30 wt %, preferably 5 to 20 wt % of the total dry weight of the dry powder constituents. Cemented carbides made from these powders are commonly used in tool forming tools and wear parts, e.g. buttons for drill bits mining or asphalt milling hot rolls , parts for mining applications, wire drawing etc.

In one embodiment of the present invention, a cemented carbide body is made of hard constituents suitably comprising WC having a grain size between 4 to 25 μm, preferably between 4.5 to 20 μm. The binder metal content is suitably between 3 to 30 wt %, preferably 6 to 30 wt % of the total dry weight of the dry powder constituents. Cemented carbides made from these powders are commonly used in buttons for drill bits, mining or asphalt milling, hot rolls.

In one embodiment of the present invention, a cemented carbide body is made where the WC raw material suitably have a single crystal WC having a spherical or angular morphology. These types of WC are typically manufactured by carburizing at a high temperature and subsequently being de-agglomerated. The actual determination of the shape of the WC crystal, i.e. spherical or angular, is usually done by first choosing the correct raw material, i.e. a WC powder made by de-agglomerating spherical or angular tungsten-metal powder followed by high temperature carburization to maintain the rounded particle shape and keep a mono crystalline nature in the tungsten carbide powder. The WC raw material powder is usually examined in a Scanning Electron Microscope to determine if the powder is single crystalline or agglomerated and what morphology or shape the grains have. The shape is then confirmed by measurements after sintering.

The spherical or angular WC raw material suitably has an average grain size (FSSS) of from between 0.2 to 30 μm, preferably 1 to 8 μm, more preferably from 2 to 4 μm and most preferably from 2.5 to 3.0 μm. The amount of spherical or angular WC added is suitably between 70 to 97 wt %, preferably between 83 to 97 wt %, more preferably between 85 to 95 wt %. The amount of binder phase is suitably between 3 to 30 wt %, preferably between 3 to 17 wt %, more preferably between 5 to 15 wt %.

The cemented carbide made from the spherical or angular WC raw material can also comprise smaller amounts of other hard constituents as listed above. The grain size of the hard constitutes can have a mean size of below 1 μm and up to 8 μm, depending on the grade application.

By spherical is herein meant grains that have a "round" shape, not the exact mathematical definition of spherical.

'Spherical' WC herein refers to the grain morphology as measured after sintering. This can be analyzed using a micrograph of a large number of grains and measuring the ratio between the diameter of the largest circle that may be inscribed within the grain dimension, d1, and the diameter for the smallest circle that the grain dimension fits into, d2. The Riley ratio (ψ) is then determined by the equation:

$$\psi = \sqrt{\frac{d1}{d2}}$$

A sphere has the Riley ratio of 1 whereas "rounded" grains are considered in the art to have a ratio below 1.3.

In one embodiment of the present invention, the WC grains are spherical after sintering and suitably have a Riley ratio of below 1.5, preferably between from 1.2 to 1.5.

By angular WC is herein meant that the WC has the shape of truncated tri-gonal prisms. Angular WC grains suitably have a Riley ratio of above 1.5.

In another embodiment of the present invention the method relates to making a cermet body. By cermet is herein meant that the hard constituents comprising large amounts of TiCN and/or TiC. Cermets comprise carbonitride or carbide hard constituents embedded in a metallic binder phase. In addition to titanium, group VIa elements, such as Mo, W and sometimes Cr, are added to facilitate wetting between binder and hard constituents and to strengthen the binder by means of solution hardening. Group IVa and/or Va elements, i.e., Zr, Hf, V, Nb and Ta, can also be added in commercial alloys available today. All these additional elements are usually added as carbides, nitrides and/or carbonitrides. The grain size of the powders forming hard constituents is usually <2 μm.

An organic binder is also optionally added to the powder blend or to the slurry in order to facilitate the granulation during the following spray drying operation but also to function as a pressing agent for any following pressing and sintering operations. The organic binder can be any binder commonly used in the art. The organic binder can e.g. be paraffin, polyethylene glycol (PEG), long chain fatty acids etc. The amount of organic binder is suitably between 15 and 25 vol % based on the total dry powder volume, the amount of organic binder is not included in the total dry powder volume.

In one embodiment of the present invention, the mixing is done without any mixing liquid, i.e. dry mixing. In one embodiment the organic binder can then be added in a solvent, preferably ethanol or an ethanol mixture, to form a slurry after mixing but prior to drying. In another embodiment of the present invention, a mixing liquid is added to the powder blend to form a slurry prior to the mixing operation.

Any liquid commonly used as a milling liquid in conventional cemented carbide manufacturing can be used. The milling liquid is preferably water, alcohol or an organic solvent, more preferably water or a water and alcohol mixture and most preferably a water and ethanol mixture. The properties of the slurry are dependent on amount of grinding liquid added. Since the drying of the slurry requires energy, the amount of liquid should be minimized in order to keep costs down. However, enough liquid need to be added in order to achieve a pumpable slurry and avoid clogging of the system.

Also, other compounds commonly known in the art can be added to the slurry e.g. dispersion agents, pH-adjusters etc.

Drying of the slurry is preferably done according to known techniques, in particular spray-drying. The slurry containing the powdered materials mixed with the organic liquid and possibly the organic binder is atomized through an appropriate nozzle in the drying tower where the small drops are instantaneously dried by a stream of hot gas, for instance in a stream of nitrogen, to form agglomerated granules. The formation of granules is necessary in particular for the automatic feeding of compacting tools used in the subsequent stage. For small scale experiments, other drying methods can also be used, like pan drying.

Green bodies are subsequently formed from the dried powders/granules. Any kind of forming operation known in the art can be used, e.g. injection molding, extrusion, uniaxel pressing, multiaxel pressing etc. If injection moulding or extrusion is used, additional organic binders are also added to the powder mixture.

The green bodies formed from the powders/granules made according to the present invention, is subsequently sintered according to any conventional sintering methods e.g. vacuum sintering, Sinter HIP, plasma sintering etc. The sintering technique used for each specific slurry composition is preferably the technique that would have been used for that slurry composition when the slurry was made according to conventional methods, i.e. ball milling or attritor milling.

In one embodiment of the present invention, the sintering is done by gas pressure sintering (GPS). Suitably the sintering temperature is between 1350 to 1500° C., preferably between 1400 to 1450° C. The gas is preferably an inert nature e.g. argon. The sintering suitably takes place at a pressure of between 20 bar to 1000 bar, preferably between 20 bar to 100.

In another embodiment of the present invention the sintering is done by vacuum sintering. Suitably the sintering temperature is between 1350 to 1500° C., preferably between 1400 to 1450° C.

The present invention also relates to a cemented carbide made according to the method above.

Suitable applications for cemented carbides made according to the method above include wear parts that require a combination of good hardness (wear resistance) and toughness properties.

The cemented carbide manufactured according to the above can be used in any application where cemented carbide is commonly used. In one embodiment, the cemented carbide is used in oil and gas applications such as mining bit inserts.

EXAMPLE 1

Different slurries of cemented carbide were prepared by blending powders of hard constituents like WC and $Cr_3C_2$, Co and PEG with a liquid with an ethanol/water ratio of 90/10 by weight. The WC grain size and the Co grain size given is the Fisher grain size (FSSS). The composition of the dry constituents of the slurries and the properties of the raw material are shown in Table 1. The amount of Co, WC and $Cr_3C_2$ given in wt % are based on the total dry powder constituents in the slurry. The amount of PEG is based on the total dry powder constituents of the slurry, where the amount of PEG is not included into the dry powder constituents of the slurry.

TABLE 1

| Slurry | Co (wt %) | Co (μm) | $Cr_3C_2$ (wt %) | WC (μm) | PEG wt % |
|---|---|---|---|---|---|
| Composition 1 | 10.0 | 0.5 | 0.5 | 0.8 | 2 |
| Composition 2a | 6.0 | 0.5 | — | 2.5 | 2 |

TABLE 1-continued

| Slurry | Co (wt %) | Co (μm) | $Cr_3C_2$ (wt %) | WC (μm) | PEG wt % |
|---|---|---|---|---|---|
| Composition 2b | 6.0 | 0.5 | — | 5 | 2 |
| Composition 3a | 6.3 | 0.9 | — | 5 | 2 |
| Composition 3b | 6.0* | 0.9 | — | 5* | 2 |

*Approximately 2 wt % of the cobalt originates from the WC powder which has been coated with Co by sol-gel technique as described in EP752921B1.

EXAMPLE 2

The slurry with Composition 1 from Example 1 were then subjected to a mixing operation either using a Resodyn Acoustic Mixer (LabRAM) according to the invention or a conventional paint shaker (Natalie de Lux), the slurries were then pan dried at 90° C. The mixing conditions are displayed in Table 2.

TABLE 2

| Powders | Composition | Mixer | Mixing time (s) | Energy (G) |
|---|---|---|---|---|
| Invention 1 | Composition 1 | RAM | 300 | 95 |
| Comparison 1 | Composition 1 | Natalie | 300 | N/A |

The powders were then first subjected to a conventional uniaxel pressing operation forming a green body which is subsequently subjected to a Sinter HIP operation at a sintering temperature of 1410° C.

The properties of the sintered material made from the powders are displayed in Table 3. As an additional comparison a slurry with Composition 1 made according to conventional techniques is included as Reference 1. The Reference 1 sample has been made according by first making a slurry through ball milling for 56 hours and then subjecting them to a spray drying operation. The powder was then pressed and sintered in the same way as the other samples. The average grain size for fine grained WC is not that affected by the ball milling. Where two values have been given, those represent measurements done on two different pieces from the same sintering batch.

TABLE 3

| Powders | Density ($g/cm^3$) | Com | Hc (kA/m) | Porosity | HV3 |
|---|---|---|---|---|---|
| Invention 1 | 14.47/ 14.46 | 8.06/ 8.03 | 18.76/ 18.77 | A00, B00, C00 | 1676/ 1706 |
| Comparison 1 | 14.11/ 14.32 | 8.30/ 7.69 | 18.97/ 18.50 | A00, B00, C00 Co pools | 1643/ 1701 |
| Reference 1 | 14.48 | 8.5 | 20.4 | A00, B00, C00 | 1650 |

As can be seen in Table 3, the cemented carbide made according to the invention obtains about the same properties as the Comparison 1 and the Reference 1 samples.

EXAMPLE 3

The slurry with Composition 2*a* from Example 1 were subjected to a mixing operation either using a Resodyn Acoustic Mixer (LabRAM) or a conventional paint shaker (Natalie de Lux), the slurries were then pan dried at 90° C. The mixing conditions are displayed in Table 4.

TABLE 4

| Powders | Composition | Mixer | Mixing time (s) | Energy (G) |
|---|---|---|---|---|
| Invention 2 | Composition 2a | RAM | 300 | 95 |
| Comparison 2 | Composition 2a | Natalie | 300 | N/A |

The powders were then pressed and sintered in the same way as the samples in Example 2.

The properties of the sintered material made from the powders are displayed in Table 5. As a comparison a slurry with Composition 2*b* is included as Reference 2. The Reference 2 sample has been made from Composition 2*b* according to conventional techniques, i.e. ball milling for 20 hours and then subjecting them to a spray drying operation. The powder was then pressed and sintered in the same way as the other samples. The WC grain size prior to the ball milling step is 5 μm. The WC grain size is then drastically reduced by the milling operation. After the sintering step the WC grain size is approx. 2.7 μm. All values given herein on the WC grain size as measured on the sintered material is estimated from the Hc value.

TABLE 5

| Powders | Density ($g/cm^3$) | Com | Hc (kA/m) | Porosity | HV3 |
|---|---|---|---|---|---|
| Invention 2 | 15.00/ 14.98 | 5.30/ 5.36 | 9.90/ 9.81 | A00, B00, C00 | 1408/ 1536 |
| Comparison 2 | 14.79/ 14.77 | 5.36/ 5.34 | 9.76/ 9.77 | A00, B00, C00 Co pools | 1419/ 1502 |
| Reference 2 | 14.95 | 5.7 | 11.7 | N/A | 1430 |

As can be seen in Table 5, the cemented carbide made according to the invention obtains about the same properties as the Comparison 2 and Reference 2 samples.

Figure 3:
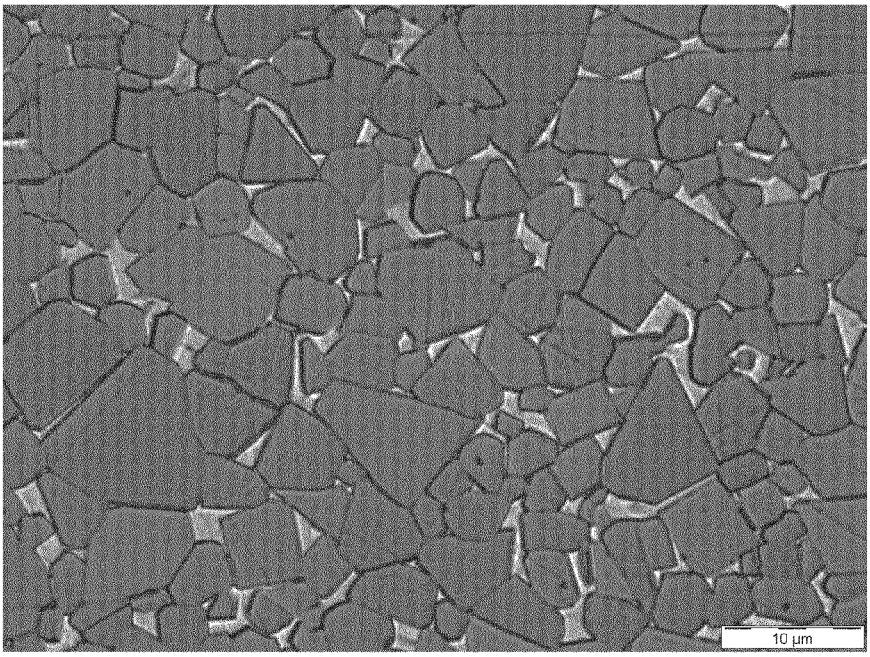
FIG. 3 shows a LOM micrograph of Invention 4 from Example 5.
Figure 4:
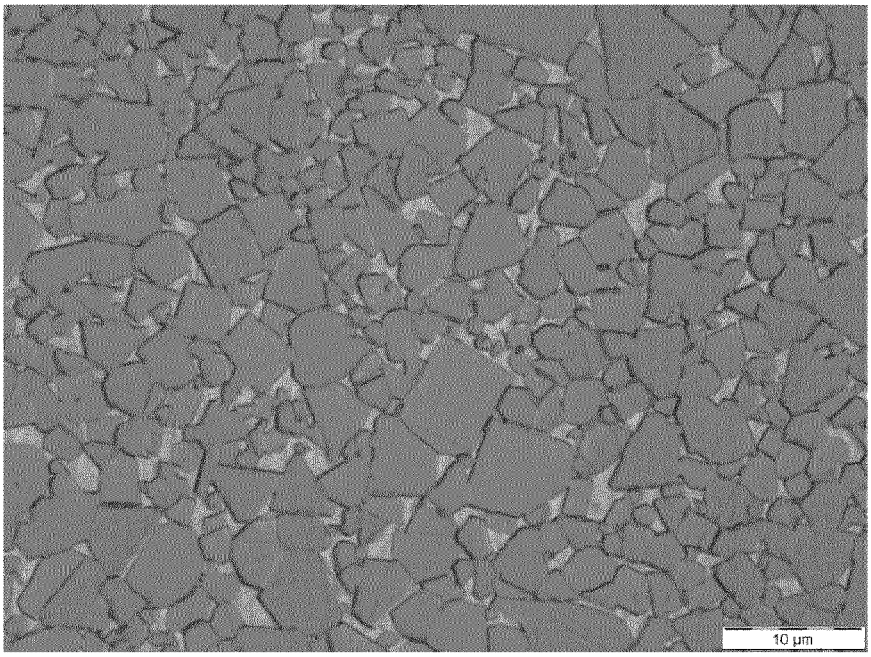
FIG. 4 shows a LOM micrograph of Comparison 4 from Example 7.

Also, for Invention 2 the narrow WC grain size distribution of the WC raw material is maintained in the sintered structure. This can be seen in FIG. 3 which shows a SEM-image (Scanning Electron Microscope) of Invention 1. FIG. 4 is showing a SEM-image of the Reference 2 sample which clearly is affected by the milling which can be seen by the presence of a number of larger grains originating from the grain growth of the fine fraction of WC grains.

EXAMPLE 4

The slurry with composition 3*a* from Example 1 were subjected to a mixing operation either using a Resodyn Acoustic Mixer (LabRAM) the slurry were then pan dried at 90° C. The mixing conditions are displayed in Table 6.

TABLE 6

| Powders | Composition | Mixer | Mixing time (s) | Energy (G) |
|---|---|---|---|---|
| Invention 3 | Composition 3a | RAM | 300 | 95 |

The powders were then pressed and sintered in the same way as the samples in Example 2 and 3.

The properties of the sintered material made from the powders are displayed in Table 7. As a comparison, a slurry with composition 3*b* is included as Reference 3. The Reference 3 sample has been made by wet mixing the powders and then subjecting them to a spray drying operation. The powder was then pressed and sintered in the same way as the other samples.

TABLE 7

| Powders | Density (g/cm$^3$) | Com | Hc (kA/m) | porosity | HV30 |
|---|---|---|---|---|---|
| Invention 3 | 14.97 | 5.72 | 5.65 | A02, B00, C00 | 1240 |
| Reference 3 | 14.95 | 5.7 | 6.8 | <A02 | 1280 |

As can be seen in Table 7, the cemented carbide made according to the invention obtains about the same properties as the Comparison 3 and Reference 3 samples. Also, it can be seen that about the same properties can be obtained for the Invention 3 where the WC is uncoated compared to Reference 3, where the WC has been coated with Co with use of the complex and expensive sol-gel process.

As a conclusion, the Examples show that the method according to the present invention can lead to products having the same properties as products been produced with conventional methods. Hence, considerable shorter milling times can be achieved leading to a decrease in energy consumption. Also, the complex sol-gel process commonly used for can be avoided.

EXAMPLE 5 (Invention)

Samples of cemented carbide comprising the hard phase WC and the binder phase Co were manufactured. The WC raw material was a single crystal WC having a typically spherical morphology, as determined by visual investigation in a Scanning Electron Microscope with an average FSSS grain size of 2 μm.

The powders of WC and Co were mixed with an ethanol-water —PEG mixture in a LabRAM acoustic mixer. The mixing was done for 5 minutes at an effect of 100% intensity.

Figure 2:
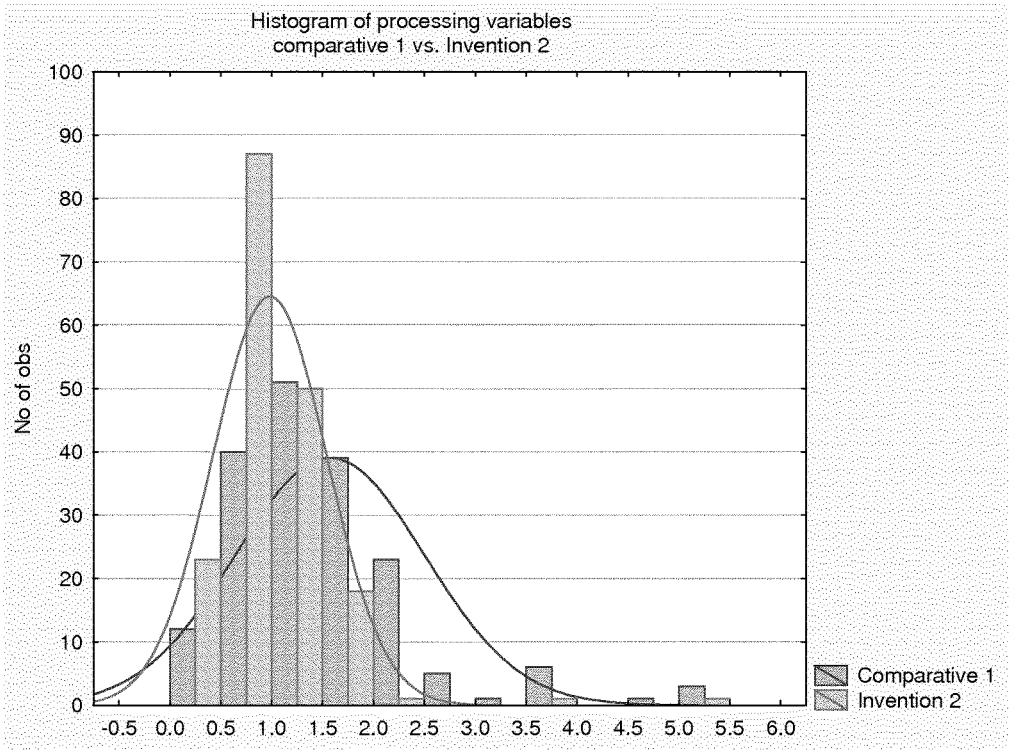
FIG. 2 shows a histogram showing the grain size distribution comparing Invention 5 and Comparison 3 from Examples 5 and 6.

After mixing the slurry was spray dried forming agglomerates which was then pressed to bodies of the shape of drill bits. The pressed bodies were GPS sintered at vacuum at a temperature of 1410° C. to dense samples of cemented carbide. The characterization of sintered grain size was done according to ISO4499. The WC grains after sintering were generally spherical with a particle size of 1.5 um and a distribution that is characterized by a Gaussian distribution, see FIGS. 2 and 3. The amounts and properties of the different raw materials are given in Table 8.

TABLE 8

| | Co content (wt %) | WC morphology | WC grain size (μm, FSSS) prior to mixing |
|---|---|---|---|
| Invention 4 | 6 | spherical | 1.5 |
| Invention 5 | 11 | spherical | 1.5 |

EXAMPLE 6 (Prior Art)

Samples of cemented carbide comprising the hard phase WC and the binder phase Co were manufactured. Powders of WC and Co according to Table 9 were wet milled in a ball mill for 10h at a ratio of milling bodies to powder of 3.6:1, spray dried and pressed to bodies of the shape of drill bits. The pressed bodies were GPS sintered at vacuum at a temperature of 1410° C. to dense samples of cemented carbide. The sample is denoted Comparison 3.

TABLE 9

| | Co (wt %) | WC morphology | WC grain size (μm, FSSS) prior to milling |
|---|---|---|---|
| Comparison 3 | 11 | angular | 4 |

EXAMPLE 7 (Prior Art)

A cemented carbide has been manufactured by the sol-gel method according to EP752921 using a cobalt acetate to coat the WC raw material with spherical morphology. After coating the slurry is dried and the Co acetate reduced with hydrogen at 450° C. The coated dry powder containing 2 wt % Co is added to a milling vessel together with the additional 4 wt % Co adjusted to achieve the grade composition as Comparison 4, including an ethanol-water mixture and a lubricant and followed by a "gentle milling", wet milling in a ball mill for 4 h at a ratio of milling bodies to powder of 2.7:1 to achieve homogeneity. The raw material powders are defined in Table 3.

TABLE 10

| | Co (wt %) | WC morphology | WC grain size (μm, FSSS) prior to milling |
|---|---|---|---|
| Comparison 4 | 6 | rounded | 4 |

EXAMPLE 8

The cemented carbide samples from examples 5, 6 and 7 were analyzed with regards to grain size, hardness and porosity. The coercivity was measured by the standard method ISO3326.

The grain size and the Riley ratio was measured from a micrograph from a polished section with mean intercept method in accordance with ISO 4499 and the values presented in Table 1 are mean values. The hardness is measured with a Vickers indenter at a polished surface in accordance with ISO 3878 using a load of 30 kg.

The porosity is measured in accordance with ISO 4505, which is a method based on studies in light microscope of polished through cuts of the samples. Good levels of porosity are equal to or below A02maxB00C00 using the ISO4505 scale. The grain size of the WC raw material is also included for comparison.

The results can be seen in Table 11.

TABLE 11

| | WC raw material (μm) | WC sintered (μm) | Hardness (HV30) | Magnetic sat. % | Hc (kA/m) | Riley ratio | Porosity |
|---|---|---|---|---|---|---|---|
| Invention 4 | 1.5 | 2 | 1270 | 93 | 5.6 | 1.16 | A02, B00, C00 |
| Invention 5 | 1.5 | 1.5 | 1250 | 90 | 8.2 | 1.29 | A02, B00, C00 |
| Comparison 3 | 4 | 4.5 | 1250 | 90 | 8.4 | 1.75 | A02, B00, C00 |
| Comparison 4 | 6 | 4.5 | 1300 | 90 | 6.8 | 1.17 | A02, B00, C00 |

As it can be seen in Table 11, the physical properties of the samples according to the present invention, Invention 4 and 5, shows equal or improved properties as compared to the prior art samples, Comparison 3 and 4.

The invention claimed is:

1. A method of making a cemented carbide or a cermet body comprising the steps of:

forming a powder blend comprising powders forming hard constituents and metal binder;

subjecting said powder blend to a mixing operation using a non-contact mixer, wherein acoustic waves achieving resonance conditions are used to form a mixed powder blend, the acoustic waves having a frequency between 20-80 Hz; and subjecting said mixed powder blend to a forming and a sintering operation.

2. The method according to claim 1, wherein an organic binder is added to the powder blend.

3. The method according to claim 1, wherein a mixing liquid is added to the powder blend to form a slurry prior to the mixing operation.

4. The method according to claim 3, wherein the slurry is subjected to a drying step performed by spray drying.

5. The method according to claim 1, wherein the powders include one or more hard constituents selected from borides, carbides, nitrides or carbonitrides of metals from groups 4, 5 and 6 of the periodic table.

6. The method according to claim 1, wherein the binder metal powder is is selected from a group of one single binder metal, a powder blend of two or more metals, or a powder of an alloy of two or more metals, wherein the binder metals are selected from Cr, Mo, Fe, Co or Ni.

7. The method according to claim 1, wherein the sintering is done by gas pressure sintering at a sintering temperature of between 1350 to 1500° C.

8. The method according to claim 1, wherein the sintering is done by vacuum sintering at a sintering temperature between 1350 to 1500° C.

9. The method according to claim 1, wherein a WC-Co based cemented carbide body is made.

10. The method according to claim 9, wherein the WC-Co based cemented carbide body is made from WC raw material of a single crystal with WC grains, the WC grains after sintering having a spherical or an angular morphology.

11. The method according to claim 9, wherein the WC grains after sintering have a spherical morphology and a Riley ratio of below 1.5.

12. The method according to claim 10, wherein the WC grains after sintering have an angular morphology with a Riley ratio above 1.5.

13. The method according to claim 1, wherein a cermet body is made.

14. The method according to claim 1, wherein a cemented carbide is made.

15. The method according to claim 1, wherein the frequency is between 50-70 Hz.

* * * * *